US011526094B2

(12) United States Patent
Adachi

(10) Patent No.: US 11,526,094 B2
(45) Date of Patent: Dec. 13, 2022

(54) CHARGING DEVICE AND IMAGE-FORMING APPARATUS CAPABLE OF PREVENTING AN INWARD INCLINING OF BEARING MEMBERS

(71) Applicant: SHARP KABUSHIKI KAISHA, Sakai (JP)

(72) Inventor: Katsumi Adachi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/673,531

(22) Filed: Feb. 16, 2022

(65) Prior Publication Data

US 2022/0299907 A1 Sep. 22, 2022

(30) Foreign Application Priority Data

Mar. 18, 2021 (JP) ..... JP2021-044478

(51) Int. Cl.
*G03G 15/02* (2006.01)

(52) U.S. Cl.
CPC ..... *G03G 15/0258* (2013.01); *G03G 15/0225* (2013.01)

(58) Field of Classification Search
CPC ..... G03G 15/0216; G03G 15/0225; G03G 15/0258
USPC ..... 399/100, 176
See application file for complete search history.

(56) References Cited

U.S. PATENT DOCUMENTS

| | | | | |
|---|---|---|---|---|
| 9,176,415 | B2 * | 11/2015 | Kobayashi | G03G 15/0225 |
| 9,915,888 | B2 * | 3/2018 | Morishita et al. | G03G 15/0225 |
| 2022/0171327 | A1 * | 6/2022 | Sakuwa | G03G 15/0225 |

FOREIGN PATENT DOCUMENTS

JP 2015-079060 A 4/2015

* cited by examiner

*Primary Examiner* — William J Royer
(74) *Attorney, Agent, or Firm* — ScienBiziP, P.C.

(57) ABSTRACT

A charging device includes: a charging roller to charge a surface of the image carrier by rotating in contact with an image carrier; a cleaning roller to clean a surface of the charging roller by rotating in contact with the charging roller; a bearing to hold the charging roller and the cleaning roller so that a distance between an axis of the charging roller and an axis of the cleaning roller is constant; and a biaser to apply a biasing force to the bearing in a direction to bring the charging roller into press contact with the image carrier, wherein the bearing has a first bearing to support the axis of the cleaning roller and a second bearing to support the axis of the charging roller, and the first bearing is disposed inward from the second bearing in a roller axial direction of the cleaning roller and the charging roller.

7 Claims, 8 Drawing Sheets

CHARGING DEVICE AND IMAGE-FORMING APPARATUS CAPABLE OF PREVENTING AN INWARD INCLINING OF BEARING MEMBERS

CROSS-REFERENCE TO RELATED APPLICATION

The present application claims priority from Japanese Application JP 2021-044478, the content of which is hereby incorporated by reference into this application.

BACKGROUND OF THE INVENTION

1. Field of the Invention

The present invention relates to a charging device and an image-forming apparatus using the same.

2. Description of the Related Art

In an electrophotographic image-forming apparatus, a charging roller as a charging device is often used to uniformly charge a surface of a photoreceptor drum. A cleaning roller to clean a surface of the charging roller can be arranged together with the charging device. The charging roller and the cleaning roller are held by bearing members each having an identical shape so that a distance between an axis of the charging roller and an axis of the cleaning roller is maintained constantly.

However, in the conventional charging device in which the charging roller and the cleaning roller are held by the bearing members each having an identical shape, it was necessary to keep an assembling state of the cleaning roller and the bearing members while the bearing members are attached to the charging device.

Specifically, as shown in FIG. 6A, at a first stage, it is necessary to attach bearing members 510 to a frame member 500 of a charging device with a shaft 521 of a cleaning roller 520 being inserted into a first bearing portion 511 for the cleaning roller 520 in the bearing members 510. This is because if the bearing members 510 are first attached to the frame member 500 alone, the cleaning roller 520 cannot be assembled thereto subsequently because the first bearing portion 511 in the bearing member 510 is formed as a through hole.

After the bearing members 510 and the cleaning roller 520 are attached to the frame member 500, a charging roller 530 is assembled to the bearing members 510, as shown in FIG. 6B. Namely, a shaft 531 of the charging roller 530 is fitted to a second bearing portion 512 for the charging roller 530 in the bearing member 510. Since the second bearing portion 512 of the bearing member 510 is formed substantially in a U-shape with an upper portion being opened, the charging roller 530 can be assembled after the bearing members 510 are attached to the frame member 500.

In FIGS. 6A and 6B, a member 501 is a bearing guide to retain the bearing member 510 to the frame member 500. A member 540 is an elastic member (e.g., a compression spring) which provides a biasing force to press the charging roller 530 against a photoreceptor drum in an image-forming apparatus.

In the attaching procedure shown in FIGS. 6A and 6B, there are some problems that the cleaning roller 520 must be kept assembled to the bearing members 510 while the bearing members 510 are being attached, which makes the cleaning roller 520 attaching work complicated and causes the cleaning roller 520 to fall out.

In order to address the above-mentioned issues, Japanese Patent Laid-open Publication No. 2015-79060 discloses a charging device having a configuration in which a shaft of a cleaning roller is shorter in length than that of a charging roller, and a bearing member has a stepped structure in a bearing portion.

The charging device disclosed in Japanese Patent Laid-open Publication No. 2015-79060, which is shown in FIG. 7A, is assembled by first attaching bearing members 550 to a frame member 500 of a charging device alone. The bearing member 550 has a stepped structure such that a position in the roller axial direction of a first bearing portion 551 for a cleaning roller 520 is different from that of a second bearing portion 552 for a charging roller 530. In such a stepped structure, both a first bearing portion 551 and a second bearing portion 552 in the bearing member 550 are formed substantially in a U-shape with the upper portions being opened. A bearing guide 501 retains the bearing member 550 at a position corresponding to the second bearing portion 552 in the roller axial direction so that it can retain the bearing member 550 fully in a height direction of the bearing member 550.

After the bearing members 550 are attached to the frame member 500, the cleaning roller 520 and the charging roller 530 are sequentially assembled to the bearing members 550, as shown in FIG. 7B. In the charging device disclosed in Japanese Patent Laid-open Publication No. 2015-79060, it is not necessary to keep an assembling state of the cleaning roller 520 and the bearing members 550 while the bearing members 550 are attached to the frame member 500, so that the difficulty of the roller attaching work may be decreased to some extent.

SUMMARY OF THE INVENTION

However, the charging device disclosed in Japanese Patent Laid-open Publication No. 2015-79060 has a problem of inward inclining of the bearing member 550 due to the stepped structure of the bearing member 550. The charging device in the image-forming apparatus is used in a state that the charging roller 530 is brought into pressure contact with a photoreceptor drum. At this time, as shown in FIG. 8, when an elastic member 540 is brought into contact with the bearing member 550 at a position corresponding to the bearing guide 501 in the roller axial direction (i.e., at a position corresponding to the second bearing portion 552), reaction force of the cleaning roller 520 pushing up the charging roller 530 is applied to the first bearing portion 551, so that the bearing members 550 become to incline inwardly (i.e., an inward inclining of the bearing member 550 occurs).

When the inward-inclining phenomenon occurs, a contact area between the shafts 521, 531 of the rollers 520, 530 and the bearing portions 551, 552 is deviated toward the end of the shafts 521, 531, and the load applied to the bearing portions 551, 552 is concentrated in a narrow contact area, so that it inhibits the smoothness of a rotating operation of the shafts 521, 531. Furthermore, when local wear and scratches on the bearing portions 551, 552 and shafts 521, 531 are increased through the long-time use of the charging device, the rotating operation of each of rollers 520, 530 becomes more unstable. Instability in the rotating operation of each of rollers 520, 530 causes non-uniformity of a charging state, which in turn causes image defects.

One aspect of the present invention has been made in light of the above-mentioned problems, and at least one object of the present invention is to provide a charging device and an image-forming apparatus capable of preventing an inward inclining of the bearing members.

In order to solve the above-mentioned problems, an aspect of the present invention provides a charging device that charges an image carrier by bringing itself into contact with the image carrier, the charging device including: a charging roller to charge a surface of the image carrier by rotating in contact with the image carrier; a cleaning roller to clean a surface of the charging roller by rotating in contact with the charging roller; a bearing to hold the charging roller and the cleaning roller so that a distance between an axis of the charging roller and an axis of the cleaning roller is constant; and a biaser to apply a biasing force to the bearing in a direction to bring the charging roller into press contact with the image carrier, wherein the bearing has a first bearing to support the axis of the cleaning roller and a second bearing to support the axis of the charging roller, the first bearing is disposed inward from the second bearing in a roller axial direction of the cleaning roller and the charging roller, and the biaser applies the biasing force to the bearing at a position corresponding to the first bearing in the roller axial direction.

According to the above-described configuration, since the first bearing is located inward from the second bearing, a reaction force from the cleaning roller pressing the charging roller is applied to the first bearing to cause the bearing to incline inwardly, while since the biaser is disposed at a position corresponding to the first bearing, the biasing force by the biaser is applied to the bearing to push it back to the opposite side (outward). As a result, the inward inclining of the bearing can be prevented, and the rotating operation of the rollers can be stabilized.

Preferably, in the above-mentioned charging device each of the first bearing and the second bearing of the bearing may be a substantially U-shaped bearing with a side facing the image carrier being opened.

According to the above-described configuration, since each of the first and second bearings is a substantially U-shaped bearing with the side facing the image carrier being opened, the roller members (the charging roller and the cleaning roller) can be attached to and detached from the bearing without removing the bearing in a state where the bearing is attached to the frame member of the charging device.

Preferably, in the above-mentioned charging device the biasing force applied to the bearing by the biaser may be greater than a load with which the charging roller is pushed up by the cleaning roller.

According to the above-described configuration, an effect of the reaction force of the cleaning roller, which is a factor of the inward inclining of the bearing, can be suppressed, and thus it is possible to effectively prevent the bearing from inclining inwardly.

Preferably, the above-mentioned charging device further includes a bearing guide to retain the bearing while guiding the bearing in a biasing direction by the biaser, wherein the biaser may apply the biasing force to the bearing at a position inward from the bearing guide in the roller axial direction.

Preferably, in the above-mentioned charging device the bearing guide may retain the bearing inward from the second bearing in the roller axial direction.

According to the above-described configuration, a load that the bearing receives from the shaft of the charging roller is balanced with a load that the bearing receives from the shaft of the cleaning roller, so that it is possible to prevent the bearing from inwardly inclining more effectively.

Preferably, in the above-mentioned charging device the axis of the cleaning roller may be shorter in length than the axis of the charging roller.

Furthermore, in order to solve the problems described above, another aspect of the present invention provides an image-forming apparatus including the above-mentioned charging device.

The charging device and the image-forming apparatus in each aspect of the present invention have the biaser disposed inwardly from the bearing guide, so that the biasing force by the biaser is applied to the bearing to push the bearing back to the opposite side (outwardly) thereby it is possible to achieve the effect in that the inward inclining of the bearing can be prevented and the rotating operation of the rollers can be stabilized.

DETAILED DESCRIPTION OF THE INVENTION

First Embodiment

Figure 1:
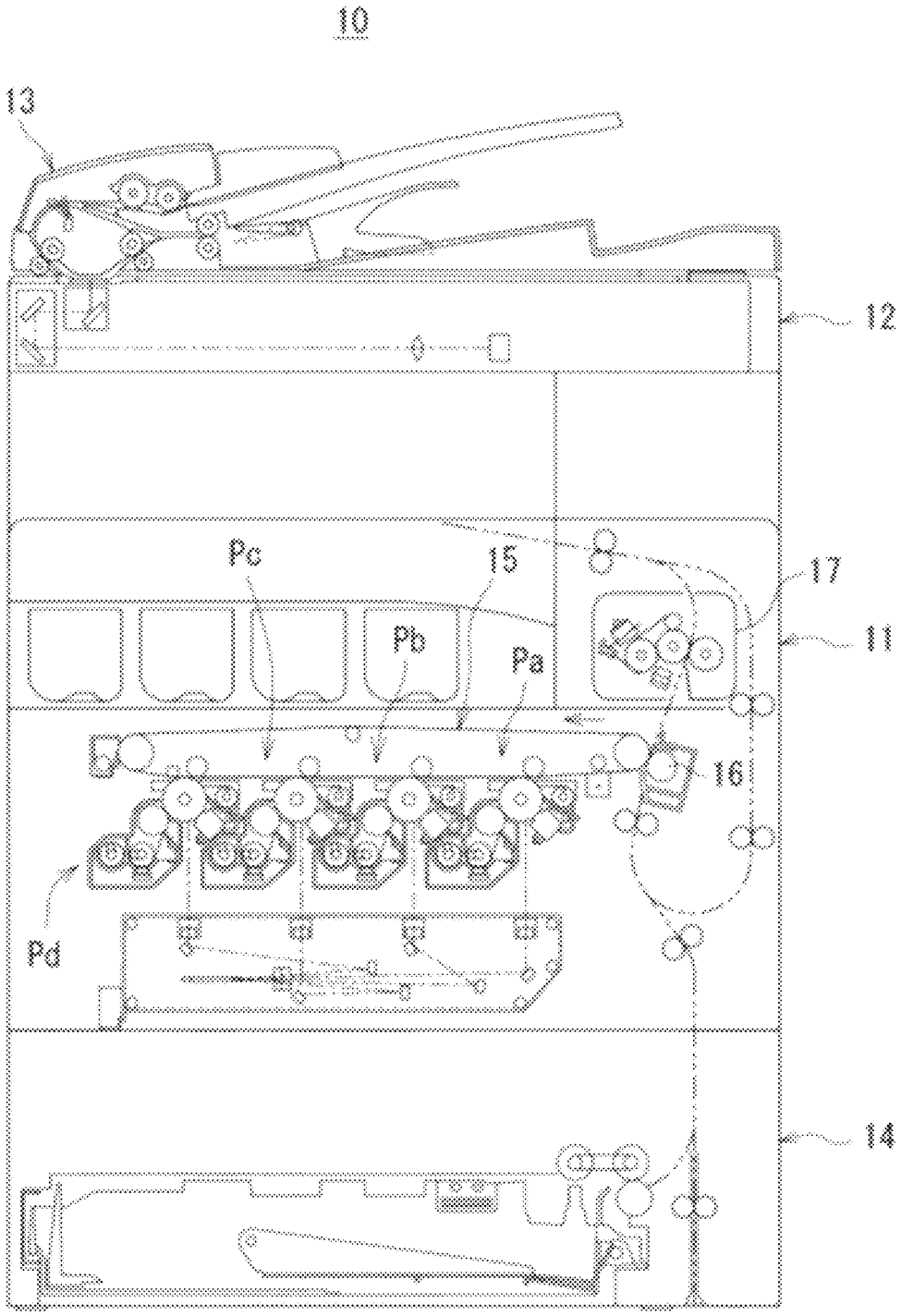
FIG. 1 is a schematic diagram illustrating an exemplary configuration of an image-forming apparatus to which the present invention is applied.

Now some embodiments of the present invention will be described below in detail with reference to the drawings. FIG. 1 is a schematic diagram illustrating an exemplary configuration of an image-forming apparatus 10 to which the present invention is applied. Although the image-forming apparatus 10 shown in FIG. 1 is a color image forming apparatus having a plurality of process units, the present invention, which is not limited thereto, can be applied to a monochrome image forming apparatus having a single process unit.

As shown in FIG. 1, the image-forming apparatus 10 is configured to include a body 11, a document reader 12, a document feeder 13, and a paper feeding device 14. The body 11 accommodates an image forming part for printing an image on a recording paper. The document reader 12 is mounted on the upper side of the body 11 and reads a document when copying the document. In an automatic reading mode, the document feeder 13 sequentially transports documents placed on a document set tray one by one toward a document placing table of the document reader 12. The paper feeding device 14 stocks recording papers and feeds a sheet thereof to the body 11 when forming an image.

The image-forming apparatus 10 can handle image data corresponding to a color image using black (K), cyan (C), magenta (M), and yellow (Y), or image data corresponding to a monochrome image using a single color (e.g., black). Therefore, the image-forming apparatus 10 includes four process units Pa, Pb, Pc, and Pd which are associated with black, cyan, magenta, and yellow, respectively. Each of the process units Pa, Pb, Pc, and Pd forms toner images according to image data by using an electrophotographic technology.

The toner images respectively formed by the process units Pa, Pb, Pc, and Pd are sequentially transferred and superimposed on an intermediate transfer belt 15. As a result, a color toner image can be formed on the intermediate transfer belt 15. The color toner image formed on the intermediate transfer belt 15 is secondarily transferred onto the recording paper with a secondary transfer unit 16, and then it is fused on the recording paper at a fixing device 17 by heating and pressurizing the recording paper.

Figure 2:
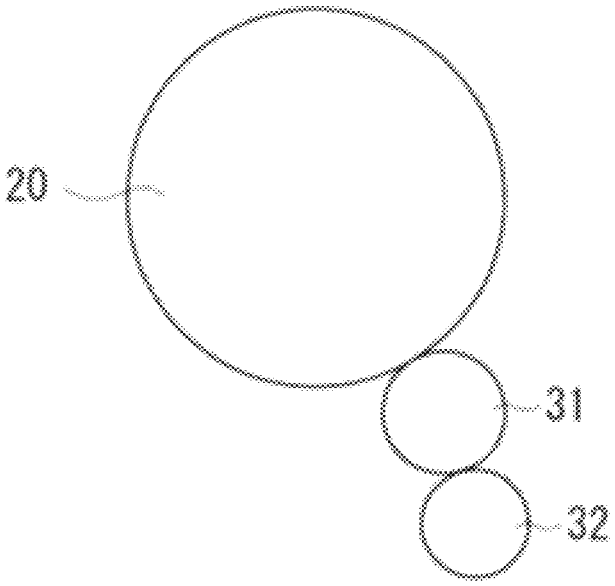
FIG. 2 is a schematic diagram illustrating a configuration of a portion of a process unit.

Each of the process units Pa, Pb, Pc, and Pd includes a charging device, an exposure unit, a developing unit, a transferer, a cleaning unit, and a destabilizer, which are arranged around a photoreceptor drum along a rotation direction thereof. As shown in FIG. 2, the charging device uniformly charges the surface of a photoreceptor drum (image carrier) 20 to a predetermined potential, and in this embodiment it is provided with a charging roller 31 and a cleaning roller 32. The charging roller 31 is a conductive roller to which a DC voltage is applied, and charges the surface of the photoreceptor drum 20 by rotating in contact with the photoreceptor drum 20. The cleaning roller 32 cleans the surface of the charging roller 31 by rotating in contact with the charging roller 31.

Figure 3:
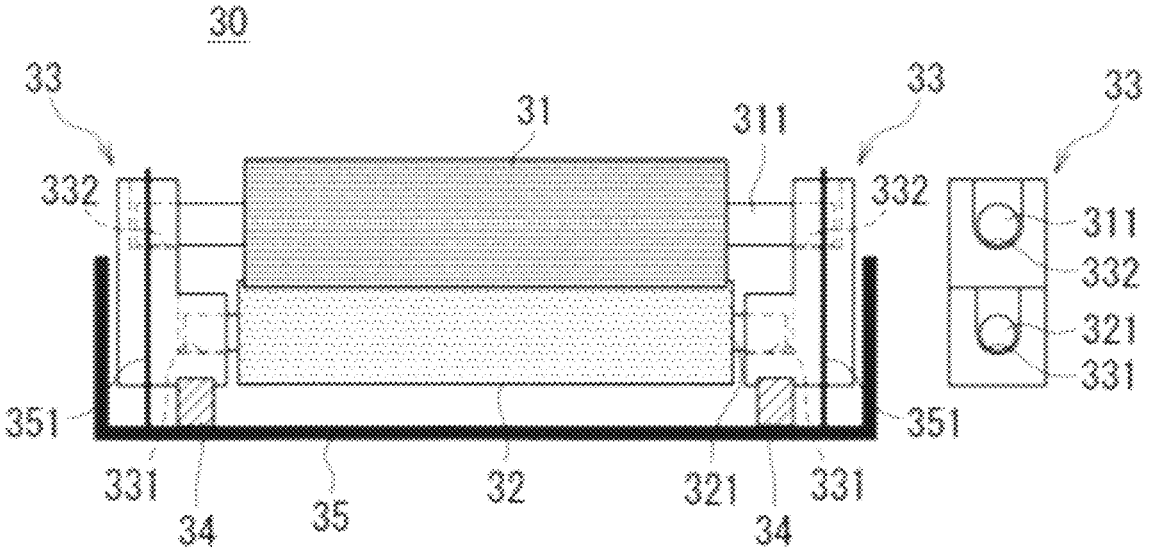
FIG. 3 is a schematic diagram illustrating a configuration of a charging unit according to a first embodiment of the invention.

Furthermore, the charging device according to this embodiment can be further unitized in each of the process units Pa, Pb, Pc, and Pd, and may be provided as a charging unit (charging device) 30. FIG. 3 is a schematic diagram of a configuration of the charging unit 30 according to the present embodiment. In the following description, for the convenience of explanation, an up and down direction in FIG. 3 as viewed from the paper is defined as an up and down direction of the charging unit 30.

As shown in FIG. 3, the charging unit 30 is configured such that the charging roller 31 and the cleaning roller 32 are attached to a frame member 35 using bearings 33 each having an identical shape. The bearings 33 (two in total) are provided at roller axial ends of the charging roller 31 and the cleaning roller 32, respectively. As the charging roller 31 and the cleaning roller 32 are held by bearings 33 each having an identical shape, a distance between an axis of the charging roller 31 and an axis of the cleaning roller 32 can be maintained constantly. As described below, the bearing 33 is biased with a biasing force from an elastic member (referred to as a biaser) 34 as well as fixed to the frame member 35 with a bearing guide 351 provided in the frame member 35.

The bearing 33 has a first bearing 331 to support a shaft (axis) 321 of the cleaning roller 32, and a second bearing 332 to support a shaft (axis) 311 of the charging roller 31. Here, the shaft 321 of the cleaning roller 32 is configured to be shorter in length than the shaft 311 of the charging roller 31. Accordingly, the bearing 33 has a stepped structure in which the first bearing 331 and the second bearing 332 are formed in a step-like shape for adapting itself to the difference in length between the shaft 311 and the shaft 321. In this case, the first bearing 331 may be disposed inward from the second bearing 332 in the roller axial direction. In addition, each of the first bearing 331 and the second bearing 332 is formed substantially in a U-shape with the upper side (a side facing the photoreceptor drum 20) being opened.

The bearing guide 351 retains the bearing 33 at a position corresponding to the second bearing 332 in the roller axial direction so that it can retain the bearing 33 fully in a height direction of the bearing 33. The bearing 33 is biased with a biasing force from the elastic member 34 disposed between the bearing 33 and the frame member 35. In the image-forming apparatus 10, the charging roller 31 is brought into pressure contact with the photoreceptor drum 20 with the biasing force from the elastic member 34. Therefore, the bearing guide 351 can retain the bearing 33 while guiding the bearing 33 toward a biasing direction of the elastic member 34.

In the charging unit 30 according to the first embodiment, the elastic member 34 is located not at a position corresponding to the bearing guide 351 in the roller axial direction (i.e., at a position corresponding to the second bearing 332) but at a position inward from the bearing guide 351 in the roller axial direction (i.e., at a position corresponding to the first bearing 331) so as to bring itself into contact with the bearing 33 (the biasing force is applied to the bearing 33).

Figure 4A:
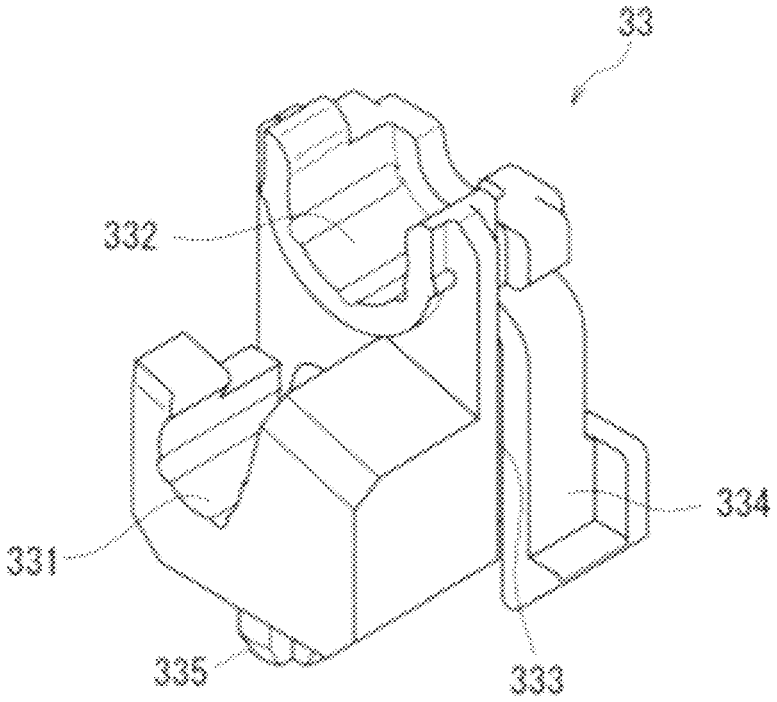
FIG. 4A is a perspective view of a bearing member.
Figure 4B:
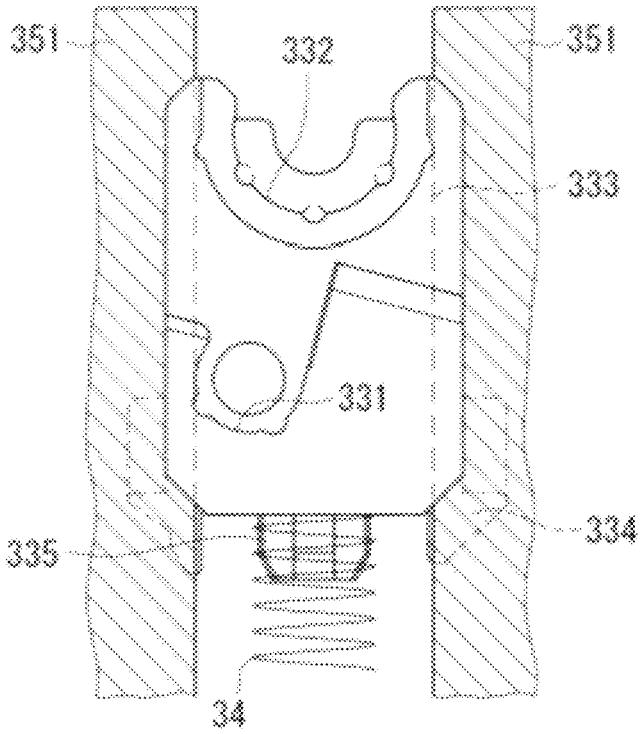
FIG. 4B is a front view illustrating the bearing member together with a bearing guide and an elastic member.
Figure 4C:
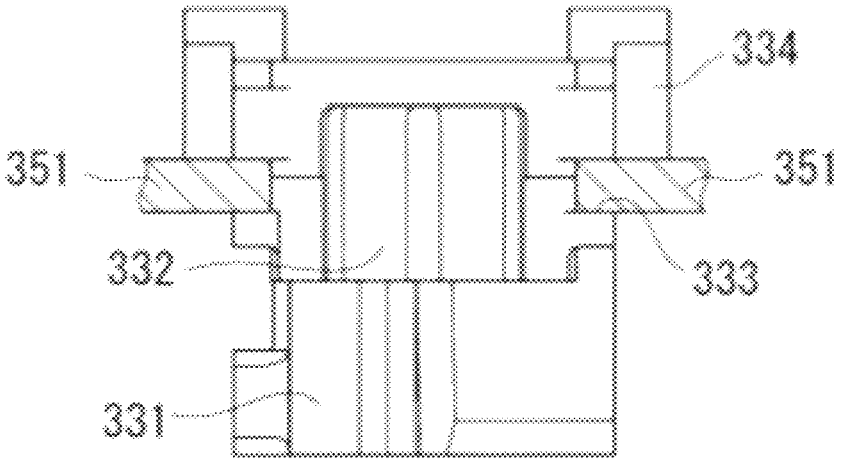
FIG. 4C is a front view illustrating the bearing member together with the bearing guide and the elastic member.
Figure 4D:
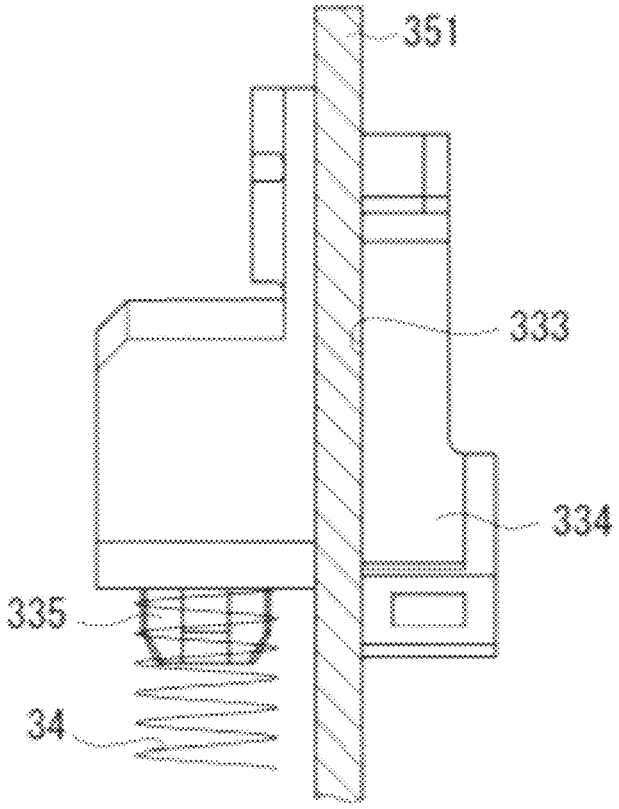
FIG. 4D is a front view illustrating the bearing member together with the bearing guide and the elastic member.

FIG. 4A is a perspective view illustrating a bearing 33. FIGS. 4B, 4C, and 4D respectively illustrate a front view, a plan view, and a side view of the bearing 33 shown in FIG. 4A together with the bearing guide 351 and the elastic member 34. As shown in FIGS. 4A, 4B, 4C, and 4D, the bearing 33 has guide grooves 333 on both sides. When attaching the bearing 33 to the frame member 35, the bearing guide 351 is fitted into the guide groove 333 by inserting the bearing 33 into the bearing guide 351 from above. As a result, the bearing 33 is attached to the frame member 35.

The bearing 33 has a fall-out prevention hook 334 on both sides. The fall-out prevention hook 334 engages with an engagement hook (not shown) provided on the frame member 35 to prevent the bearing 33 from falling out of the bearing guide 351. Furthermore, a positioning protrusion 335 for positioning the elastic member 34 is provided on a bottom surface of the bearing 33. The elastic member 34 is positioned with respect to the bearing 33 by fitting the positioning protrusion 335 into one end of the elastic member 34.

Figure 7A:
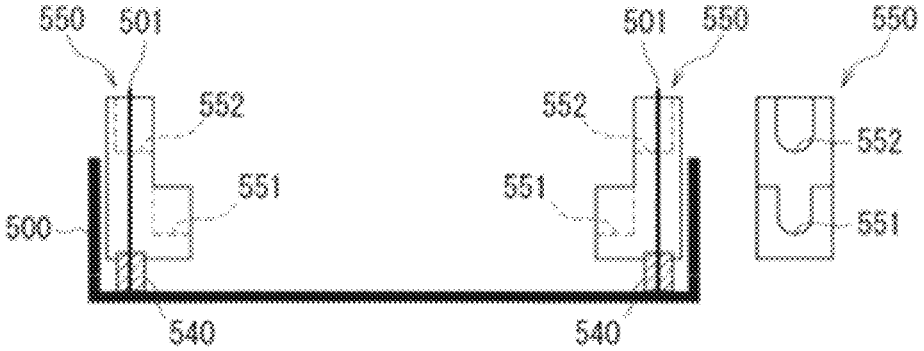
FIG. 7A PRIOR ART
FIG. 7A is a schematic diagram illustrating a prior art of a procedure for attaching a bearing member and a roller member to a charging device.
Figure 7B:
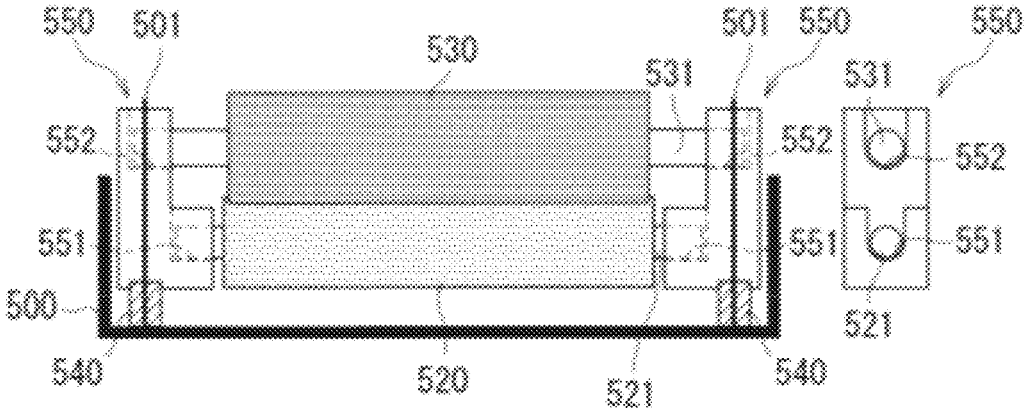
FIG. 7B PRIOR ART
FIG. 7B is a schematic diagram illustrating a prior art of a procedure for attaching the bearing member and the roller member to the charging device.

In the charging unit 30 according to the first embodiment, the bearing 33 has a stepped structure in which the first bearing 331 and the second bearing 332 are formed in a step-like shape by configurating such that the shaft 321 of the cleaning roller 32 is shorter in length than the shaft 311 of the charging roller 31. This allows the difficulty of the work for attaching the bearings 33 and the rollers to the frame member 35 to be significantly decreased. Namely, the charging unit 30 can be assembled in the same manner as the conventional charging device described with reference to FIGS. 7A and 7B, in which first the bearing 33 is attached to the frame member 35 alone, and then the cleaning roller 32 and the charging roller 31 are sequentially assembled to the bearings 33. Furthermore, the roller members (the charging roller 31 and the cleaning roller 32) only can be attached to and detached from the bearings 33 without removing the bearings 33 from the frame member 35.

Furthermore, in the charging unit 30 according to the first embodiment, when used in the image-forming apparatus 10 (when the charging roller 31 is brought into pressure contact with the photoreceptor drum 20), it is possible to prevent the bearing 33 from inwardly inclining. This is due to the following actions.

Figure 8:
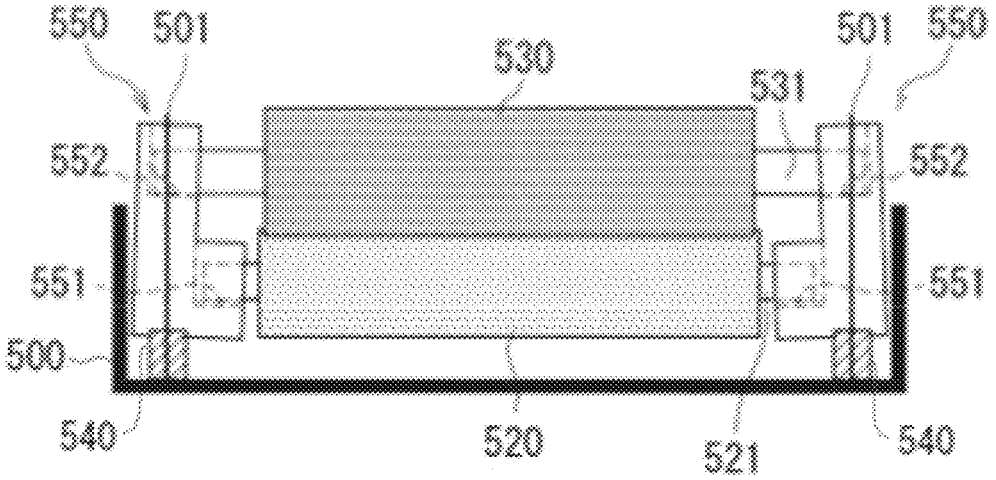
FIG. 8 PRIOR ART
FIG. 8 is a schematic diagram illustrating an inward-inclining phenomenon of a bearing member which is caused in a charging device of the prior art.

In the conventional charging device shown in FIG. 8, when the inward inclining of the bearing member 550 occurs, the cause of that is a rotational displacement in which the bearing guide 501 rotates around a base part thereof serving as a fulcrum. In contrast, in the charging unit 30 according to the first embodiment, the elastic member 34 is located not at a position corresponding to the bearing guide 351 in the roller axial direction but at a position inward from the bearing guide 351 in the roller axial direction (i.e., at a position corresponding to the first bearing 331) so as to bring itself into contact with the bearing 33.

Also in the charging unit 30, since the bearing 33 has a stepped structure, reaction force of the cleaning roller 32 pushing up the charging roller 31 is applied to the first bearing 331, force causing the bearing 33 to incline inwardly is generated. However, in the charging unit 30, since the elastic member 34 is disposed inward from the bearing guide 351, the biasing force from the elastic member 34 acts so as to push the bearing 33 back to the opposite side (outward). As a result, in the charging unit 30, the inward inclining of the bearing 33 can be prevented, and thus the rotating operation of the rollers can be stabilized.

In this case, it is also preferable that the biasing force applied to the bearing 33 by the elastic member 34 is greater than a load with which the cleaning roller 32 pushes up the charging roller 31 (i.e., a load which brings the cleaning roller 32 into press contact with the charging roller 31 at a desired bite amount). As a result, an effect of reaction force of the cleaning roller 32, which is a factor of the inward inclining of the bearing 33, can be suppressed, and thus it is possible to effectively prevent the bearing 33 from inclining inwardly.

Second Embodiment

Figure 5:
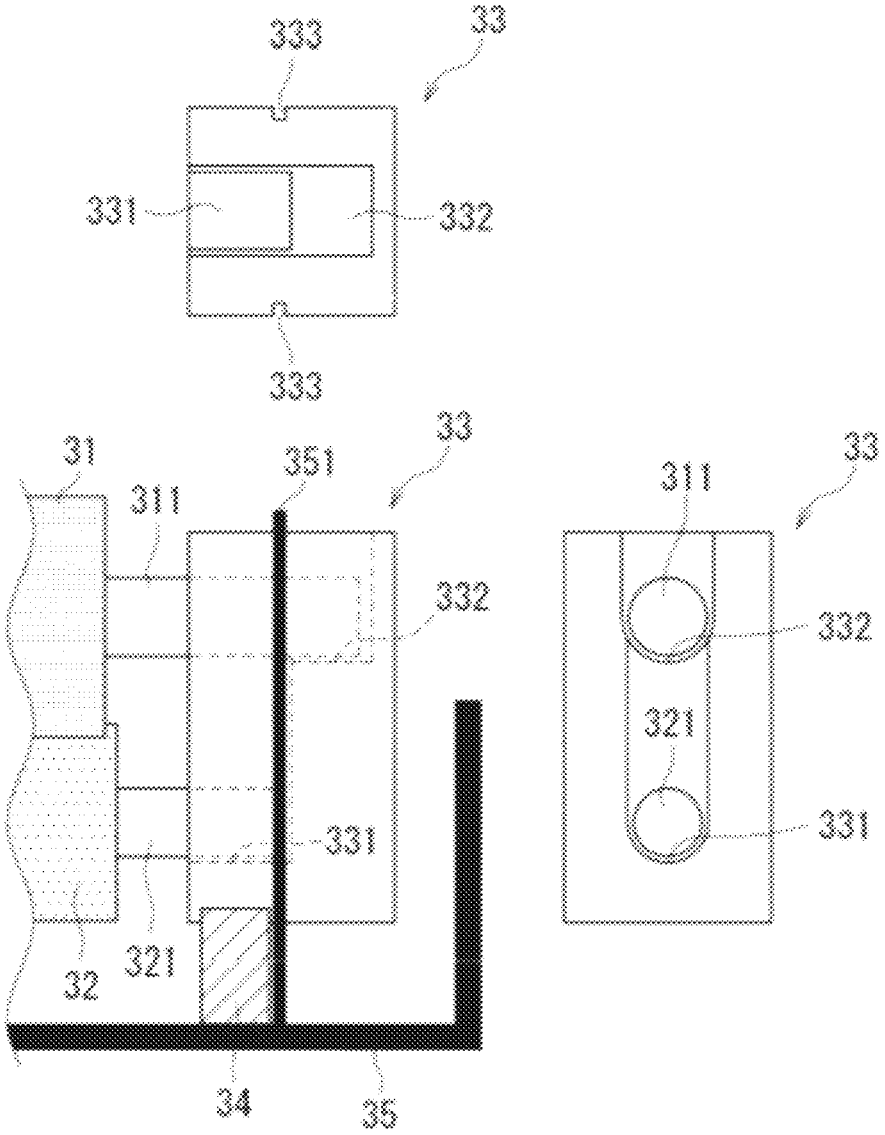
FIG. 5 is a schematic diagram illustrating a configuration of a charging unit according to a second embodiment.
Figure 6A:
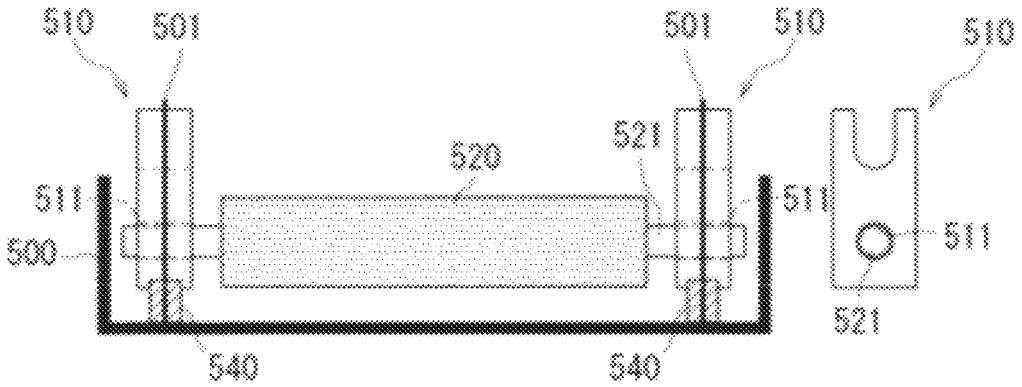
FIG. 6A PRIOR ART
FIG. 6A is a schematic diagram illustrating a prior art of a procedure for attaching a bearing member and a roller member to a charging device.
Figure 6B:
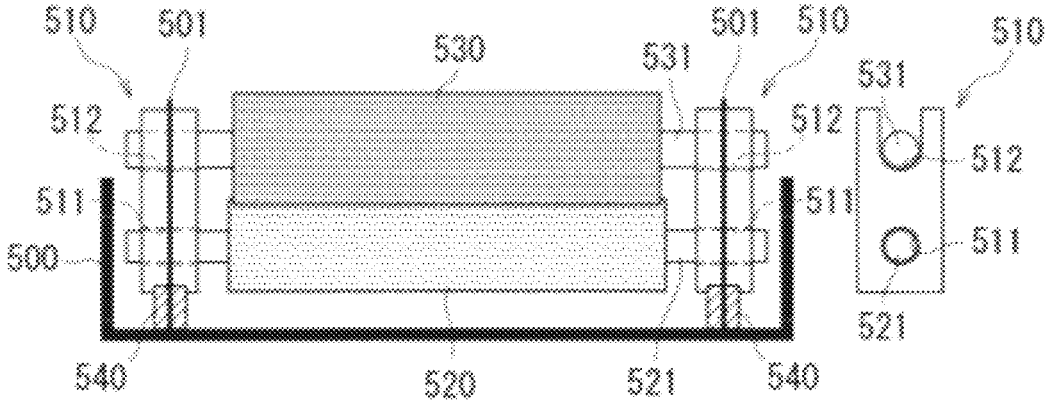
FIG. 6B PRIOR ART
FIG. 6B is a schematic diagram illustrating a prior art of a procedure for attaching the bearing member and the roller member to the charging device.

In the first embodiment described above, the bearing guide 351 retains the bearing 33 at a position corresponding to the second bearing 332 in the roller axial direction. However, the present invention is not limited to the embodiment. For example, as shown in FIG. 5, the bearing guide 351 may retain the bearing 33 inward from the second bearing 332 in the roller axial direction.

In this case, the first bearing 331 supporting the cleaning roller 32 is located inward from the bearing guide 351 in the roller axial direction, and the second bearing 332 supporting the charging roller 31 is located outward from the bearing guide 351 in the roller axial direction. As a result, a load that the bearing 33 receives from the shaft 311 is balanced with a load that the bearing 33 receives from the shaft 321, so that it is possible to prevent the bearing 33 from inwardly inclining more effectively.

It should be noted that the embodiments disclosed herein are illustrated as only examples in all respects and do not serve as a basis for a limited interpretation. Therefore, the technical scope of the present invention is not interpreted based on only the above-described embodiments but defined based on a statement in the claims. Furthermore, any changes and modifications within the meaning and range equivalent to the claims fall within the scope of the invention.

What is claimed is:

1. A charging device that charges an image carrier by bringing itself into contact with the image carrier, the charging device comprising:

a charging roller to charge a surface of the image carrier by rotating in contact with the image carrier;

a cleaning roller to clean a surface of the charging roller by rotating in contact with the charging roller;

a bearing to hold the charging roller and the cleaning roller so that a distance between an axis of the charging roller and an axis of the cleaning roller is constant; and a biaser to apply a biasing force to the bearing in a direction to bring the charging roller into press contact with the image carrier, wherein the bearing has a first bearing to support the axis of the cleaning roller and a second bearing to support the axis of the charging roller, the first bearing is disposed inward from the second bearing in a roller axial direction of the cleaning roller and the charging roller, and the biaser applies the biasing force to the bearing at a position corresponding to the first bearing in the roller axial direction.

2. The charging device according to claim 1, wherein each of the first bearing and the second bearing of the bearing is a substantially U-shaped bearing with a side facing the image carrier being opened.

3. The charging device according to claim 1, wherein the biasing force applied to the bearing by the biaser is greater than a load with which the charging roller is pushed up by the cleaning roller.

4. The charging device according to claim 1 further comprising a bearing guide to retain the bearing while guiding the bearing in a biasing direction by the biaser, wherein the biaser applies the biasing force to the bearing at a position inward from the bearing guide in the roller axial direction.

5. The charging device according to claim 4, wherein the bearing guide retains the bearing inward from the second bearing in the roller axial direction.

6. The charging device according to claim 1, wherein the axis of the cleaning roller is shorter in length than the axis of the charging roller.

7. An image-forming apparatus comprising the charging device according to claim 1.

* * * * *